US006490736B2

(12) United States Patent
Phillips

(10) Patent No.: US 6,490,736 B2
(45) Date of Patent: Dec. 10, 2002

(54) PROTECTIVE GARMENT

(76) Inventor: Anthony Grey Phillips, 539 N. Main St., Suffield, CT (US) 06078

( * ) Notice: Subject to any disclaimer, the term of this patent is extended or adjusted under 35 U.S.C. 154(b) by 0 days.

(21) Appl. No.: 10/075,131

(22) Filed: Feb. 12, 2002

(65) Prior Publication Data

US 2002/0112278 A1 Aug. 22, 2002

Related U.S. Application Data

(63) Continuation-in-part of application No. 09/775,902, filed on Feb. 2, 2001.

(60) Provisional application No. 60/179,790, filed on Feb. 2, 2000.

(51) Int. Cl.[7] ..... A41D 13/00

(52) U.S. Cl. ..... 2/242; 2/24

(58) Field of Search ..... 2/16, 455, 22, 2/24, 44, 46, 59, 62, 242, 311, 911; 128/99.1, 100.1, 876, 878, 881, 882; 602/23, 26, 1, 41, 62; 119/856

(56) References Cited

U.S. PATENT DOCUMENTS 5,137,508 A * 8/1992 Engman ..... 119/850
5,395,399 A * 3/1995 Rosenwald ..... 607/108
5,653,244 A * 8/1997 Shaw ..... 128/882
6,048,326 A * 4/2000 Davis et al. ..... 602/26

* cited by examiner

*Primary Examiner*—John J. Calvert
*Assistant Examiner*—Tajash D Patel

(57) ABSTRACT

In a protective garment, a facing and backing layer are positioned adjacent one another with a layer of insulating material interposed therebetween. The layers are sewn together in a quilted pattern defined by lines of stitching, portions of which include closely spaced patterns of reinforcing stitches. The facing and backing layers as well as the insulating layer of material are sized to extend around and partway along the limb of a wearer with fasteners extending along opposed lateral edges to releasably attach the garment to the wearer's limb.

In addition, the protective garment can be comprised of man-made material or non-man-made material, such as, but not limited to, leather wherein there would be no backing or insulating material. There would be no quilting stitches nor reinforcing stitches. The man-made material or non-man-made material are sized to extend around and partway along the limb of a wearer with fasteners extending along opposed lateral edges to releasably attach the garment to the wearer's limb.

12 Claims, 2 Drawing Sheets

Fig. 1
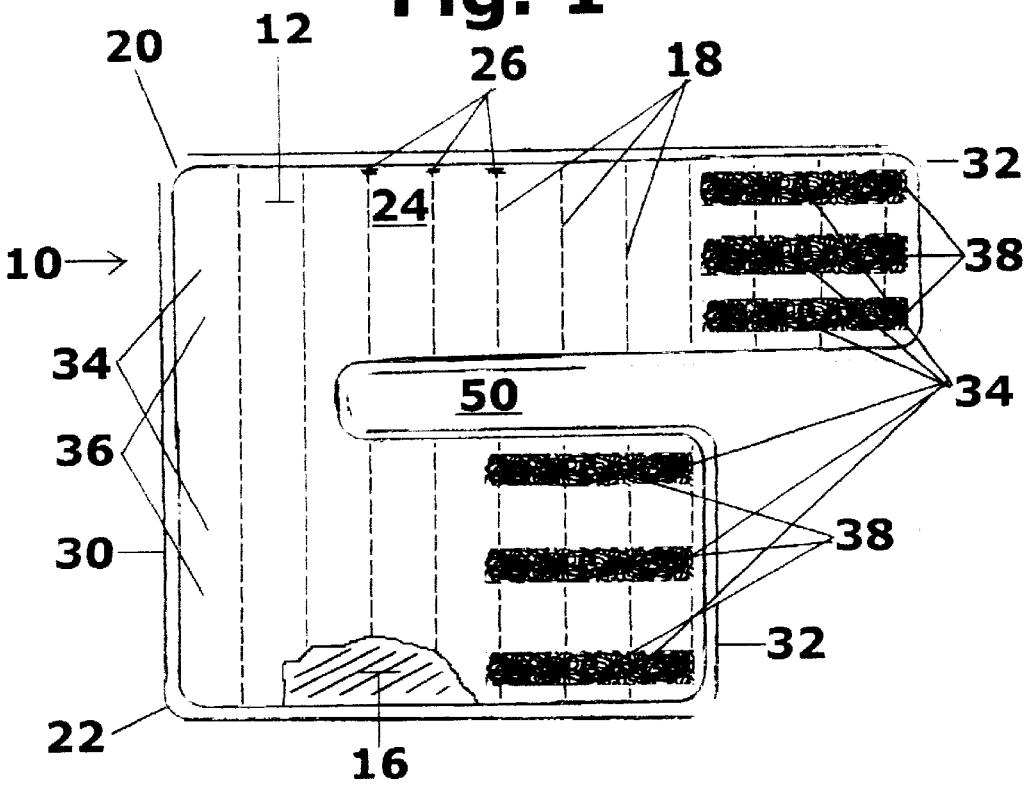
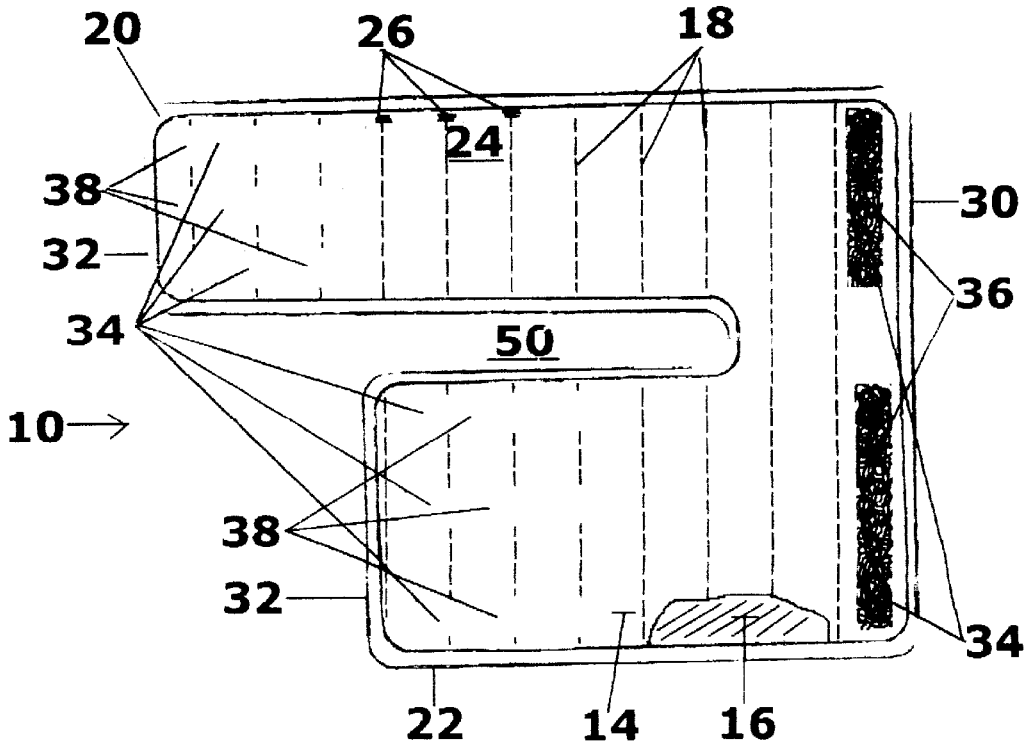
Fig. 2

Fig. 3
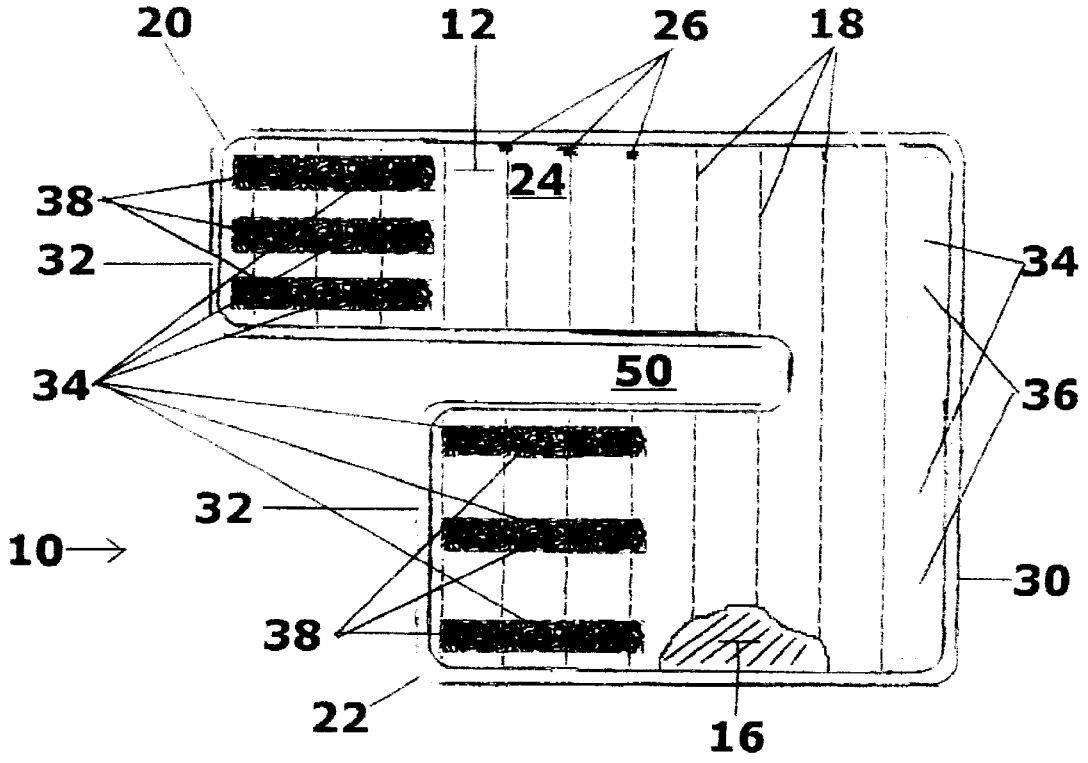
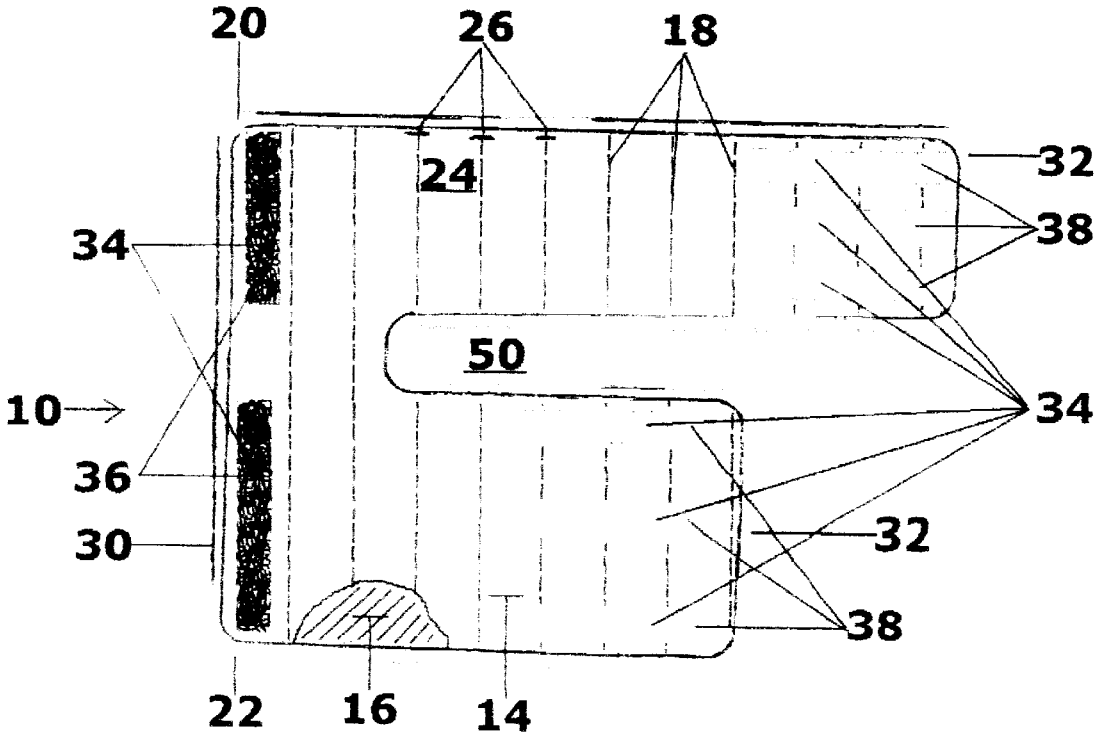
Fig. 4

PROTECTIVE GARMENT

CROSS REFERENCE TO RELATED APPLICATION

This is continuation in-part of Application No. 09/775,902, filed Feb. 2, 2001, and this application claims priority to U.S. Provisional patent application Ser. No. 60/179,790, filed Feb. 2, 2000, which is herein incorporated by reference.

FIELD OF THE INVENTION

This invention relates generally to protective garments, and is more specifically directed to garments for selectively protecting portions of a person's body from overexposure to the elements.

BACKGROUND OF THE INVENTION

The use of garments to protect against inclement weather is well known. For example, outdoorsmen, and other people subjected to the elements, have used various protective garments to insulate themselves against the adverse effects of cold and wetness. Motorcyclists and snowmobilers typically employ multiple layers of clothing to combat the adverse effects of exposure. However, additional layers of clothing can become heavy, bulky, slippery, and/or cumbersome, especially if they become soaked or coated with water or ice. Such problems are undesirable since mobility of the wearer is impaired, potentially preventing the safe operation of the motorcycle or snowmobile.

A problem associated with wearing bulky garments or several layers is that sometimes additional protection is only needed at localized body areas which are more susceptible to, or more exposed to, cold or wet weather conditions. For example, when riding a motorcycle or snowmobile, extra protection in the front or back of the thighs, or over the knee area, is desirable. At other times, extra protection is only desired towards the ends of the limbs (e.g. calves, forearms) which tend to cool quicker than the trunk of the body in an exposed environment. The bottom portions of the legs are especially susceptible to temperature extremes, as they are often closer to accumulated precipitation.

Tubes of fabric having annular and /or other strands of elastic material, commonly referred to as legwarmers, are a known garment for protecting the lower legs against the cold. However, legwarmers are generally not designed with material that significantly protects against wetness. Additionally, the limited elastic quality of legwarmers generally constrains the amount of clothing and/or thickness of the limb that a legwarmer can be pulled or fitted over without constraining blood flow or unduly damaging the legwarmer. Legwarmers also tend to lose a significant amount of elasticity during repeated/extended usage, resulting in an inability to maintain proper placement, uncomfortable bunching, and/or limited ability to retain body heat.

Based on the foregoing, it is the general object of the present invention to overcome the problems and drawbacks of prior art protective garments.

SUMMARY OF THE INVENTION

In one aspect, the present invention is directed to a protective garment which includes coupled facing and backing layers of material sized to extend around and partway along the limb of a wearer. The facing and backing layers of material are quilted via one or more lines of stitching. Fastening means are used to join opposed edge portions of the facing and backing after the protective garment is wrapped around a limb of the wearer.

In the first preferred embodiment of the present invention, a layer of insulating material is interposed between said facing and backing layers of material, and the stitching includes quilting thread sewn along the facing and backing to create a channeled pattern. The layer of insulating material is usually composed of material having good insulating quality, such as 10.5 ounce polyester batting. Further, the facing is made of waterproof or water-resistant material such as 200 denier nylon coated with polyurethane. The backing can be 68 denier nylon or taffeta. Preferably, the quilting thread is fine enough so as not to create holes in the facing and backing sufficient in size to allow the ready passage of water. Of course, it is to understood that the present invention contemplates that the facing and backing layers of material, as well as the layer of insulating material, could be made from any number of garment materials. Additionally, manners of stitching other than channel patterns of fine quilting thread can be utilized.

Preferably, the protective garment defines one or more slots extending from one or more of the opposed edge portions of the garment. Preferably, one approximately U-shaped slot extends from one of the opposed edge portions of the protective garment, thereby defining two projections. During wear, the slot is positioned over the joint, thereby allowing comfortable flexion of the joint.

Preferably, the fastening means for joining the opposed edge portions of the garment are strips of hook and loop fastening material sewn to the facing and backing layers of material. One strip of hooked fastening material is sewn on the backing layer along one of the opposed edge portions, while three spaced strips of loop fastening material are sewn on the facing layer adjacent to the other opposed edge portion and approximately perpendicular to the strip of hooked fastening material.

The strips of looped fastening material are sized to allow adjustment over a substantial range to accommodate varying limb sizes. The facing and backing layers of material and strips of loop fastener material are sized to allow the typical user to secure two layers of the garment over an area of a limb susceptible to the adverse effect of the elements.

It is to be understood that the present invention contemplates that the number, position, and orientation of the strips of hooked and looped fastening material can vary from that of the preferred embodiment. Furthermore, any other number of fastening means can be utilized.

Additionally, a bias can be sewn around the periphery of the garment. The bias provides a border around the protective garment which helps to prevent foreign objects and water from getting between the facing and backing layers of material.

BRIEF DESCRIPTION OF THE DRAWINGS

FIG. 1 is a front elevational view of the right side of a pair of the first embodiment of the present invention partially cut away to show a layer of insulating material.

FIG. 2 is a rear elevational view of the right side of a pair of the first embodiment of the present invention partially cut away to show a layer of insulating material.

FIG. 3 is a front elevational view of the left side of a pair of the first embodiment of the present invention partially cut away to show a layer of insulating material.

FIG. 4 is a rear elevational view of the left side of a pair of the first embodiment of the present invention partially cut away to show a layer of insulating material.

DETAILED DESCRIPTION OF THE PREFERRED EMBODIMENT

As shown in FIGS. 1, 2, 3, and 4, a protective garment generally designated by the reference number 10 includes a facing layer of material 12 and a backing layer of material 14. The facing and backing layers of material 12 and 14, respectively, are approximately the same size and shape and include a layer of insulating material 16 interposed between them. In the illustrated embodiment, the facing, backing and insulating layers 12, 14, and 16, respectively, are sewn together and include lines of stitch 18 which cause the protective garment 10 to become quilted. Preferably, the lines of stitch 18 are formed using quilting thread; however, the invention is not limited in this regard as other types of material known to those skilled in the pertinent art to which the invention pertains can be substituted for the quilting thread without departing from the broader aspects of the present invention.

In the illustrated embodiment, the protective garment 10 defines an outer periphery 20 covered by a bias 22. In addition, the lines of stitching 18 forming the quilting include portions 24 having a pattern of closely spaced reinforcing stitches 26 adapted to prevent the quilting from coming apart during wear.

The protective garment 10 defines opposing sides 30 and 32, adjacent to which are attached fasteners 34 for joining these ends together when the garment is wrapped around the limb of a user. In the illustrated embodiment, these fasteners 34 are in the form of hook and loop fastening material with a plurality of strips (two shown) of hooked material 36 extending along one of the said opposed edges 30, and a plurality of strips (six shown) 38 of looped fastening material being attached adjacent to the other of the opposing ends 32 approximately perpendicular to the strips of hooked material. However, the present invention is not limited in this regard as the hooked and looped strips of material 36, 38 can be substituted for one another without departing from the broader aspects of the present invention. Moreover, while hook and loop fasteners are shown and described, the present invention is not limited in this regard as other types of fasteners, such as, but not limited to, buttons or zippers can be employed without departing from the broader aspects of the present invention.

The protective garment 10 defines a slot 50 that extends inwardly from one of the opposed edges of the garment. In the illustrated embodiment, the slot is shown as being approximately U-shaped; however, the invention is not limited in this regard as other shaped slots such as rectangular, triangular, or hourglass may be substituted without departing from the broader aspects of the present invention. The slot 50 is designed to be positioned over a joint such as the elbow or knee of the wearer, thereby preventing bunching of the garment behind the joint causing discomfort to the wearer; however, the invention is not limited in this regard as material may be sewn or affixed over the slot 50 without departing from the broader aspects of the present invention.

While the present invention has been shown and described as being fabricated from layers of nylon and insulating material, the invention is not limited in this regard as other textile or non-textile material, such as leather, which would not require layering or reinforcing stitches, could be substituted without departing from the broader aspects of the present invention.

Preferably, the layer of insulating material 16 is made from a 10.5 ounce polyester batting material with the facing layer of material 12 being 200 denier nylon coated with polyurethane and the backing layer material 14 being 68 denier nylon. However, the invention is not limited in this regard as other weights of water-resistant, water-proof, or water-repellant coatings other than polyurethane, can be substituted, as can other suitable materials for facing and/or backing, without departing from the broader aspects of the present invention. In addition, the protective garment 10 shown in FIGS. 1, 2, 3, and 4 as being sized to extend approximately the full length of the user's limb. However, the protection garment can be sized to extend partway up a limb, or example, slightly above or below the knee or elbow of the user. During use of the protective garment 10, a wearer would wrap the garment around his or her limb, attaching the opposing edges with the hook and loop fasteners. The plurality of strips extending along one of the opposed edges 30, 32 allow for adjustment of the garment to accommodate larger or smaller limbs.

While preferred embodiments have been shown and described, various Modifications and substitutions may be made without departing from the spirit and scope of the invention. Accordingly, it is to be understood that the present invention has been described by way of example, and not by limitation.

What is claimed is:

1. A protective garment comprising:

at least one layer of planar sheet of material defining opposed edge portions which is sized to extend around and partway along the limb of the wearer;

wherein the protective garment comprises one or more slots which extends from one of the opposed edge portions into the protective garment;

said one of the opposed edge portion extends in a straight line, while the other opposed edge portion includes a top longitudinal member extending further than a bottom longitudinal member; and the top and bottom longitudinal members includes fastening means for joining said opposed edge portions, after the protective garment is wrapped around the limb.

2. The protective garment of claim 1, wherein said fastening means includes first and second hook and loop fasteners attached to said edge portions.

3. The protective garment of claim 2, wherein said first hook and loop fasteners include at least one strip of material having one of said hook or loop fasteners thereon and at least one second strip of material having the other of said hook or loop fasteners thereon, and wherein said first strip of material is adjacent to one of said opposed edge portions and the second strip of material is adjacent to the other of said opposed edge portions.

4. The protective garment of claim 2, wherein said first and second strips of material are approximately perpendicular to one another.

5. The protective garment of claim 1, wherein said at least one layer of planar sheet of material includes facing and backing layers being quilted by at least one line of stitching.

6. The protective garment of claim 5, further comprising a bias coupled to said facing and backing layers of material so as to form a border extending at least partway around a periphery defined by said protective garment.

7. The protective garment of claim 5, wherein said backing layer of material is taffeta.

8. The protective garment of claim 5, wherein said facing layer of material is nylon.

9. The protective garment of claim 8, wherein said nylon or any suitable material is coated with polyurethane.

10. The protective garment of claim 5, wherein the facing and backing layers comprises a layer of insulating material interposed therebetween.

11. The protective garment of claim 10, wherein the layer of insulating material is polyester batting.

12. The protective garment of claim 5, wherein the at least one line of stitching includes quilting thread.

* * * * *